US005157404A

United States Patent [19]

Rowe et al.

[11] Patent Number: 5,157,404

[45] Date of Patent: Oct. 20, 1992

[54] PHASED ARRAYS

[75] Inventors: Stephen P. Rowe; Christopher J. Tarran, both of Hampshire, England

[73] Assignee: Roke Manor Research Limited, Romsey, England

[21] Appl. No.: 801,462

[22] Filed: Dec. 2, 1991

[30] Foreign Application Priority Data

Dec. 5, 1990 [GB] United Kingdom ..... 9026509

[51] Int. Cl.[5] ..... H01Q 3/22; H01Q 3/24; H01Q 3/26

[52] U.S. Cl. ..... 342/372; 342/377

[58] Field of Search ..... 342/376, 377, 372

[56] References Cited

U.S. PATENT DOCUMENTS 5,008,680 4/1991 Willey et al. ..... 342/372

*Primary Examiner*—Theodore M. Blum

*Attorney, Agent, or Firm*—Keck, Mahin & Cate

[57] ABSTRACT

A phased array system comprising a plurality of elements each element being arranged to transmit/receive signals with a predetermined phase and/or amplitude with respect to other elements of the array, whereby a beam steering function is afforded, each element of the array including a transducer, the trnasducers of the array elements being placed in communication with at least three reference stations which are spaced apart in three dimensions such that data communication between each transducer and the reference stations can be used to define the position of each element relative to the stations and wherein the phase and/or amplitude of signals transmitted and/or received by the elements is determined in dependence upon the said relative position thus defined, whereby improved beam steering accuracy is afforded.

4 Claims, 1 Drawing Sheet

PHASED ARRAYS

Figure 1:
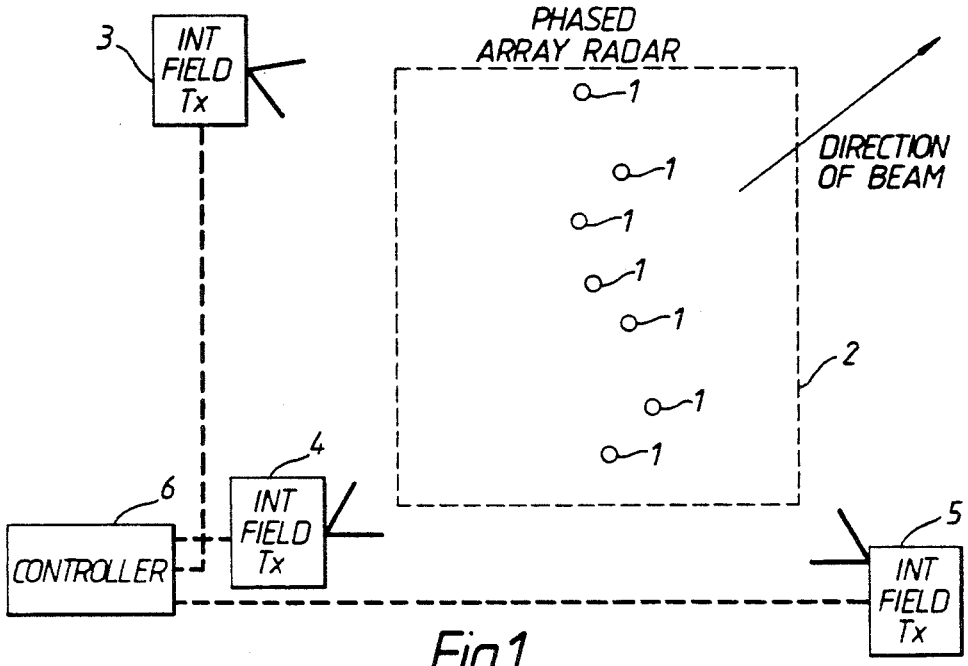

This invention relates to phased arrays, and more especially but not exclusively it relates to phased three dimensional arrays.

Three dimensional phased antenna arrays typically comprise a plurality of elements arranged randomly in spaced apart relationship within a three dimensional space having a predetermined configuration and dimensions.

Such arrays are normally steered by controlling the phase and/or amplitude of signals transmitted and/or received by individual elements of the array. In order accurately to steer such arrays, the phase and/or amplitude of signals transmitted and/or received by each element must be weighted very precisely having regard to the exact location in space of each element and with very large arrays, as may comprise a VHF or UHF active phased array radar comprising a number of transmitter/receiver modules each having its own associated antenna element, this is especially important.

Precise location of elements in such arrays can present a serious problem, especially in applications where element location might be affected by wind.

One object of the present invention therefore is to provide for the precise location of each element of an array, whereby improved beam steering accuracy is facilitated.

According to the present invention a phased array system comprises a plurality of elements each element being arranged to transmit/receive signals with a predetermined phase and/or amplitude with respect to other elements of the array, whereby a beam steering function is afforded, each element of the array including a transducer, the transducers of the array elements being placed in communication with at least three reference stations which are spaced apart in three dimensions such that data communication between each transducer and the reference stations can be used to define the position of each element relative to the stations and wherein the phase and/or amplitude of signals transmitted and/or received by the elements is determined in dependence upon the said relative position thus defined, whereby improved beam steering accuracy is afforded.

In accordance with one embodiment of the invention, the transducers may be arranged to transmit signals to form an information field, which signals are analysed in a central processor unit (CPU) having regard to the relative phase of signals received at the reference stations, whereby the relative position of each transducer is established such that appropriate phase and/or amplitude weighting can be applied at each transducer thereby to provide for the execution of a predetermine beam steering function.

In accordance with an alternative embodiment of the invention the transducers may be arranged to receive signals transmitted by the reference stations to form an information field, which signals are compared to determine, in dependence upon their relative phase, the relative position of each transducer whereby a required phase and/or amplitude weighting function can be calculated to afford a predetermined beam steering function.

The transducers and or the reference station may be arranged to communicate using ultrasonic radiation to form the information field which ultrasonic radiation will not interfere with radio/radar communication signals as may be used to generate the array beams.

Beam steering techniques and signal processing techniques which may be used having determined the position of the elements of an array using an ultrasonic information field are well known and will not be described herein in detail. It will also be appreciated that various other kinds of radiation may be used to define an information field used to determine the element positions and for example light radiation in the visible or non-visible spectra may be used.

Figure 2:
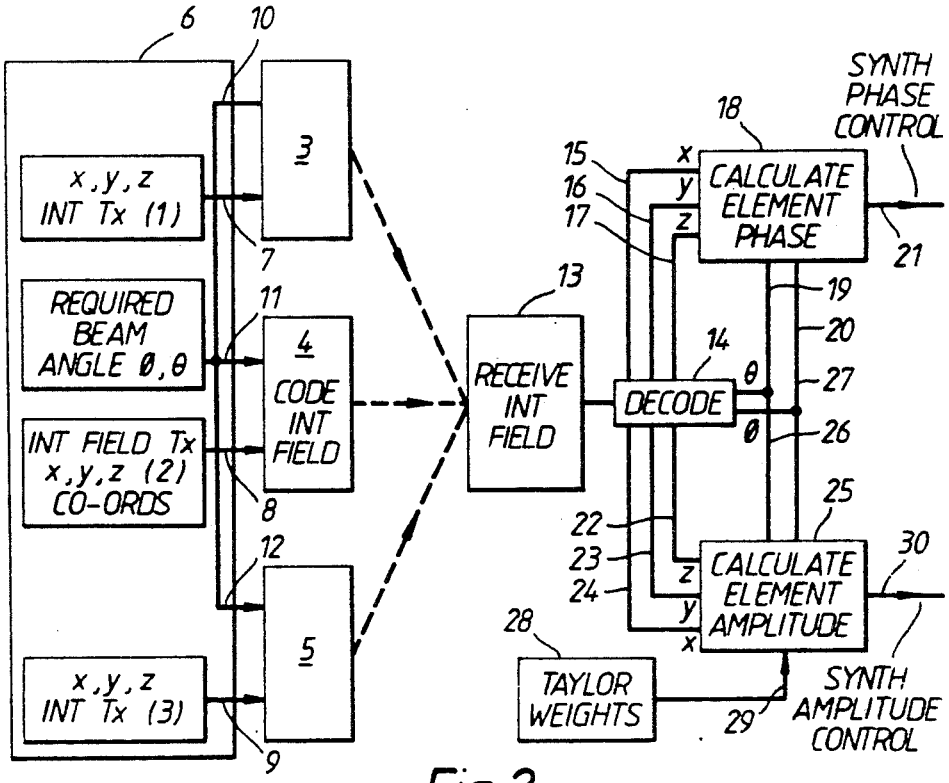

However, in order to facilitate a better understanding of the invention, one embodiment will now be described by way of example with reference to the accompanying drawings in which:

FIG. 1 is a generally schematic diagram showing the layout of phased array elements in relation to three reference stations, and FIG. 2 is a generally schematic block diagram of the arrangement shown in FIG. 1.

Referring now to FIG. 1 a phased array radar system comprises a plurality of elements 1 only some of which are shown. It is envisaged that the elements may be distributed randomly within a three dimensional space as indicated in one plane only, by the broken line 2 in FIG. 1.

The array elements each include transmitter/receiver antenna elements and associated circuitry used for beam steering purposes, and a transducer for an information field, these parts not being shown in FIG. 1. The transducers are arranged to operate on a specified ultrasonic frequency thereby to communicate, through the medium of an ultrasonic information field, with reference stations 3, 4 and 5. The transducers may be arranged to receive acoustic energy radiated from the reference stations 3, 4 and 5 whereby using triangulation techniques and phase comparison techniques which are well known, the precise position of each transducer and thus each element with which it is associated may be computed. Alternatively in an equivalent mirror image arrangement, the transducers operatively associated with each of the elements 1, may be arranged to transmit signals, perhaps on a time division multiplex basis, which are received by the reference stations 3, 4 and 5, the signals being used to compute precisely the position of each transducer and thus the position of its associated element. Signals received by the reference stations 3, 4 and 5 are fed to a central processor 6 wherein computations, as aforesaid, are made.

Referring now to FIG. 2, wherein parts corresponding to FIG. 1, bear the same numerical designations, the reference stations 3, 4 and 5 are arranged to transmit signals which define their precise relative positions, these signals being established in the CPU 6 and fed to the reference stations 3, 4 and 5 via lines 7, 8 and 9 respectively. Additionally, the reference stations 3, 4 and 5 are arranged to transmit information appertaining to a required beam steering angle which signals define the phase and amplitude weighting required to produce the required beam steering function. This information is fed from the CPU to the reference stations 3, 4 and 5 via lines 10, 11 and 12 respectively. Each element of the array (i.e. the element 1 shown in FIG. 1) comprises a receiving transducer 13 responsive to the information field radiated by the reference stations 3, 4 and 5, and in the present example ultrasonic energy is used for the information field which is transmitted in a suitably coded form. However, in alternative arrangements, other information fields may be used using electro magnetic radiation such as light for example. Signals received by the antenna 13 are fed to a decoder unit 14 which serves to decode the received signals and to provide information on lines 15, 16 and 17 for a phase calculation unit 18 which also receives on lines 19 and 20 signals appertaining to a required beam steering function, such that an output signal on a line 21 is provided which defines the precise phase of the signal to be radiated to produce the beam steering function specified. In a similar manner, the decoder unit 14 provides on lines 22, 23 and 24, signals for an amplitude computation unit 25 which is fed also with beam steering information on lines 26 and 27 so that the unit 25, which also takes account of Taylor weighting functions stored in a look-up table 28 as provided on a line 29, can provide an output signal on a line 30 appertaining to the appropriate amplitude weighting function required. In the present example it is envisaged that the elements 1 are, for beam generation purposes, active elements and thus the signals on lines 21 and 30 are applied to output amplifiers (not shown) to provide control of the radiated signal to afford the appropriate phase and amplitude required for a particular beam steering function.

Various modifications may be made to the arrangement just before described without departing from the scope of the invention and for example it will be appreciated that a mirror image arrangement may be provided whereby the reference stations 3, 4 and 5 are arranged to receive signals which are transmitted from a transmission transducer corresponding to the receiving transducer 13.

It will also be appreciated that in a two dimensional planar array or in a three dimensional array as just before described it is possible precisely to define the position of each element of the array whereby improved beam steering operation is afforded.

We claim:

1. A phased array system comprising a plurality of elements each element being arranged to transmit and receive signals with at least one of a predetermined phase and a predetermined amplitude with respect to other elements of the array, whereby a beam steering function is afforded, each element of the array including a transducer, the transducers of the array elements being placed in communication with at least three reference stations which are spaced apart in three dimensions such that data communication between each transducer and the reference stations can be used to define the position of each element relative to the stations and wherein at least one of the phase and the amplitude of signals transmitted or received by the elements is determined in dependence upon the said relative position thus defined, whereby improved beam steering accuracy is afforded.

2. A phased array system as claimed in claim 1 wherein the transducers are arranged to transmit signals to form an information field, which signals are analysed in a central processor unit (CPU) having regard to the relative phase of signals received at the reference stations, whereby the relative position of each transducer is established such that at least one of an appropriate phase and appropriate amplitude weighting can be applied at each transducer thereby to provide for the execution of a predetermine beam steering function.

3. A phased array system as claimed in claim 1 wherein the transducers are arranged to receive signals transmitted by the reference stations to form an information field, which signals are compared to determine, in dependence upon their relative phase, the relative position of each transducer whereby at least one of a required phase and a required amplitude weighting function can be calculated to afford a predetermined beam steering function.

4. A phased array system as claimed in claim 1 wherein the transducers and or the reference stations are arranged to communicate using ultrasonic radiation to form the information field.

* * * * *